US009474436B2

(12) United States Patent
Seu

(10) Patent No.: US 9,474,436 B2
(45) Date of Patent: Oct. 25, 2016

(54) CUTLERY TRAY FOR DISHWASHER

(71) Applicant: Indesit Company S.p.A., Fabriano (IT)

(72) Inventor: Antonio Seu, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/758,599

(22) PCT Filed: Dec. 27, 2013

(86) PCT No.: PCT/IB2013/061360
§ 371 (c)(1),
(2) Date: Jun. 30, 2015

(87) PCT Pub. No.: WO2014/102737
PCT Pub. Date: Jul. 3, 2014

(65) Prior Publication Data

US 2015/0335225 A1 Nov. 26, 2015

(30) Foreign Application Priority Data

Dec. 31, 2012 (IT) ..... TO2012A1172

(51) Int. Cl.
*A47L 15/50* (2006.01)

(52) U.S. Cl.
CPC ..... *A47L 15/502* (2013.01); *A47L 15/505* (2013.01); *A47L 15/507* (2013.01)

(58) Field of Classification Search
CPC ..... A47L 15/502; A47L 15/505
USPC ..... 211/41.8, 41.9
See application file for complete search history.

(56) References Cited

U.S. PATENT DOCUMENTS 958,857 A * 5/1910 Dennis ..... A47J 47/20 134/135
5,016,772 A * 5/1991 Wilk ..... B65D 21/086 220/495.01

(Continued)

FOREIGN PATENT DOCUMENTS

DE 102010042409 A1 4/2012
EP 2201887 A1 6/2010

(Continued)

OTHER PUBLICATIONS

ISR International Patent Application No. PCT/IB2013061360, filed Dec. 27, 2013 mailed date May 12, 2014, Applicant: Indesit Company SPA. International Publication No. WO2014102737A1, publication date: Jul. 3, 2014.

(Continued)

*Primary Examiner* — Stanton L Krycinski

(57) ABSTRACT

A dishwasher cutlery tray comprises a frame which is withdrawably mounted in a wash-tub and a plurality of inserts arranged in a movable manner on the frame and on which tableware items to be washed can be arranged. At least one first insert and one second insert are arranged on the frame in a horizontally displaceable manner. The cutlery tray further comprises first coupling means for coupling in a releasable manner the first insert to the second insert in such a way that, in a condition of coupling of the first coupling means, the first insert is horizontally displaceable on the frame together with the second insert and in a condition of release of the coupling means the first insert and the second insert are horizontally displaceable on the frame independently to each another.

17 Claims, 7 Drawing Sheets

(56) References Cited

U.S. PATENT DOCUMENTS

| | | | | |
|---|---|---|---|---|
| 5,083,827 | A * | 1/1992 | Hollenbaugh, Sr. | B60R 13/01 220/4.08 |
| 7,455,066 | B2 * | 11/2008 | Feddema | A47L 15/502 134/56 D |
| 7,862,664 | B2 * | 1/2011 | Choi | A47L 15/502 134/201 |
| 8,163,103 | B2 * | 4/2012 | Shin | A47L 15/502 134/56 D |
| 8,196,593 | B2 * | 6/2012 | Schessl | A47L 15/502 134/135 |
| 8,746,467 | B2 * | 6/2014 | Jeong | A47L 15/502 211/126.2 |
| 9,161,677 | B2 * | 10/2015 | Hofpeter | A47L 15/502 |
| 2006/0219271 | A1 * | 10/2006 | Feddema | A47L 15/502 134/56 D |
| 2006/0250058 | A1 * | 11/2006 | Stevens | A47L 15/502 312/311 |
| 2008/0072937 | A1 * | 3/2008 | Choi | A47L 15/502 134/137 |
| 2008/0156358 | A1 * | 7/2008 | Shin | A47L 15/502 134/137 |
| 2010/0078048 | A1 * | 4/2010 | Schessl | A47L 15/502 134/115 R |
| 2010/0155280 | A1 * | 6/2010 | Graute | A47L 15/502 206/372 |
| 2012/0139400 | A1 * | 6/2012 | Hofpeter | A47L 15/505 312/228.1 |

FOREIGN PATENT DOCUMENTS

| | | | |
|---|---|---|---|
| EP | 2292140 | A1 | 3/2011 |
| FR | 2958146 | A1 | 10/2011 |

OTHER PUBLICATIONS

International Patent Application No. PCT/IB2013061360, filed Dec. 27, 2013, Applicant: Indesit Company SPA. International Publication No. WO2014102737A1, publication date: Jul. 3, 2014.

* cited by examiner

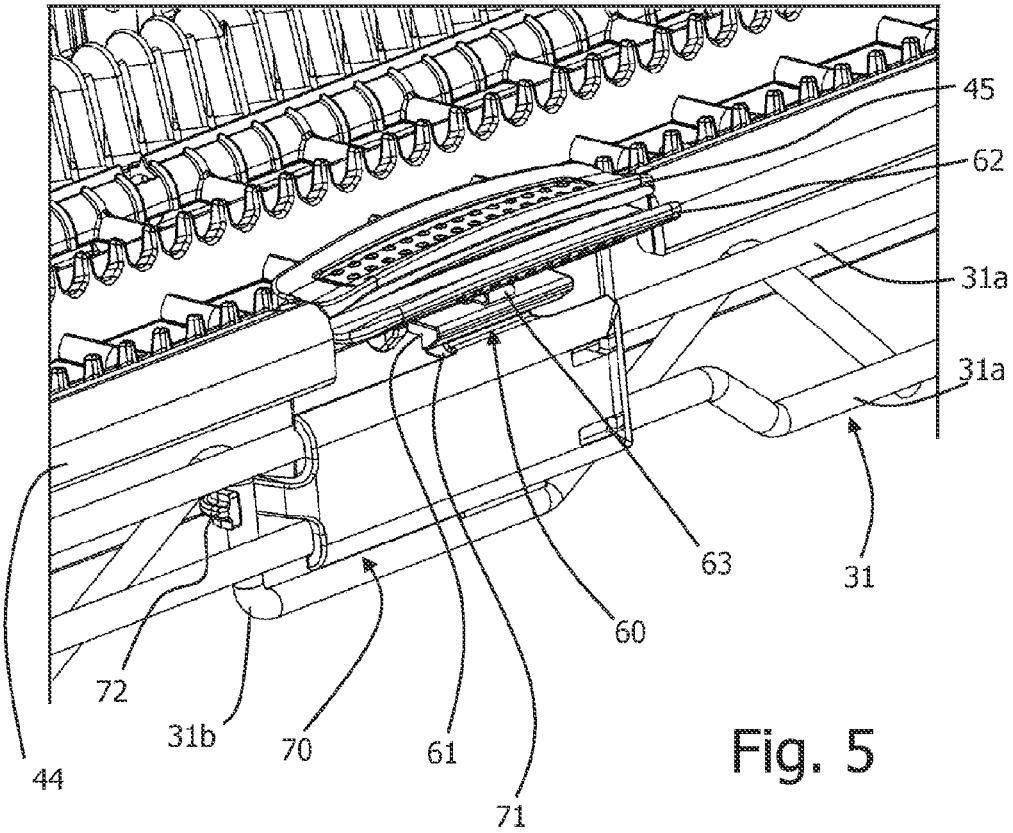
Fig. 5
Fig. 6
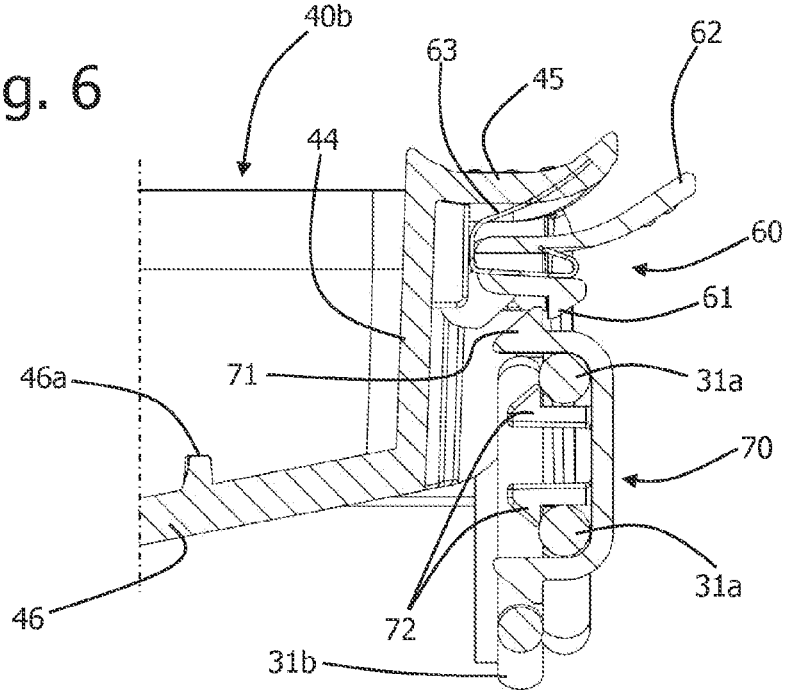

CUTLERY TRAY FOR DISHWASHER

BACKGROUND OF THE DISCLOSURE

The present disclosure relates to domestic dishwashers and it has been developed with particular reference to cutlery trays for these machines.

The domestic dishwashers usually comprise a wash-tub, inside of which are housed in extractable manner at least two crockery baskets and at least two sprinklers, which are located usually one below the lower basket and the other one below the upper basket. Certain dishwashers also comprise a third sprinkler member, placed above the upper crockery basket, for example, a substantially shower like sprinkler, mounted at the upper wall of the tub.

Some machines provided with the said third sprinkler also have a cutlery tray, mounted inside of the tub in a position between the upper basket and the third sprinkler These trays can be mounted directly on the structure of the upper basket or have its own supporting frame, which can be removable from the front of the tub as a drawer, i.e. similarly to the crockery baskets, but with vertical dimension very reduced.

A cutlery tray according to the preamble of claim 1 is known, for example, from EP 2201887 A. In this solution, the cutlery tray includes its own frame, which is mounted extractable in the machine wash tub, and a plurality of inserts that are arranged in a movable way on the frame and on which tableware items that must be washed can be arranged. On the frame are arranged two horizontally displaceable lateral inserts, in a direction transverse to the direction of extraction of the frame from the tub, and an intermediate insert vertically displaceable, with the three inserts that allow changing the configuration of the tray as a whole. In particular, in a configuration of the tray, the two lateral inserts are on the two sides of the intermediate insert, so as to allow a maximum load capacity of the tray; in this condition the intermediate insert can in turn be in a lower position or in a higher position, allowing respectively the load on the tray of more or less bulky objects. Each of the two lateral inserts can be horizontally moved above the intermediate insert, in a condition that, on the one hand, decreases the load capacity of the tray but that, on the other hand, also reduces the overall plan dimension of the three inserts: in this way, a part of the area circumscribed by the support frame is freed by a corresponding part of the insert, and in this space can eventually project tableware items particularly cumbersome in height, that are arranged on the upper crockery basket Obviously, the possibility to horizontally move the two lateral inserts allows a user to choose if freeing the space within the frame at the right or at the left of the central vertically displaceable insert.

SUMMARY OF THE DISCLOSURE

An aim of the disclosure is to provide a cutlery tray with improved structure and reliability of use, particularly in the context of reducing the risk of undesirable variations in the operating configuration of parts of the tray itself. An auxiliary aim of the disclosure is to provide a cutlery tray having greater use flexibility, particularly in relation to the possibility of different positioning of several parts of the tray itself.

One or more of these aims is/are achieved, according to the present disclosure, by a cutlery tray having the characteristics indicated in claim 1. Preferred characteristics of the disclosure are indicated in the dependent claims.

The claims are an integral part of the technical teaching provided herein in relation to the disclosure.

BRIEF DESCRIPTION OF THE DRAWINGS

Further aims, characteristics and advantages of the present disclosure will become apparent from the description that follows, with reference to the attached drawings, provided for purely illustrative and not limiting purpose, in which:

FIG. 5 is a schematic and partial perspective view of a cutlery tray part according to the disclosure, with corresponding means for releasable coupling or hooking of one insert thereof to a corresponding support frame;

FIG. 6 is a schematic and partial section of the means for coupling or hooking of FIG. 5, in a condition of use;

Figure 2:
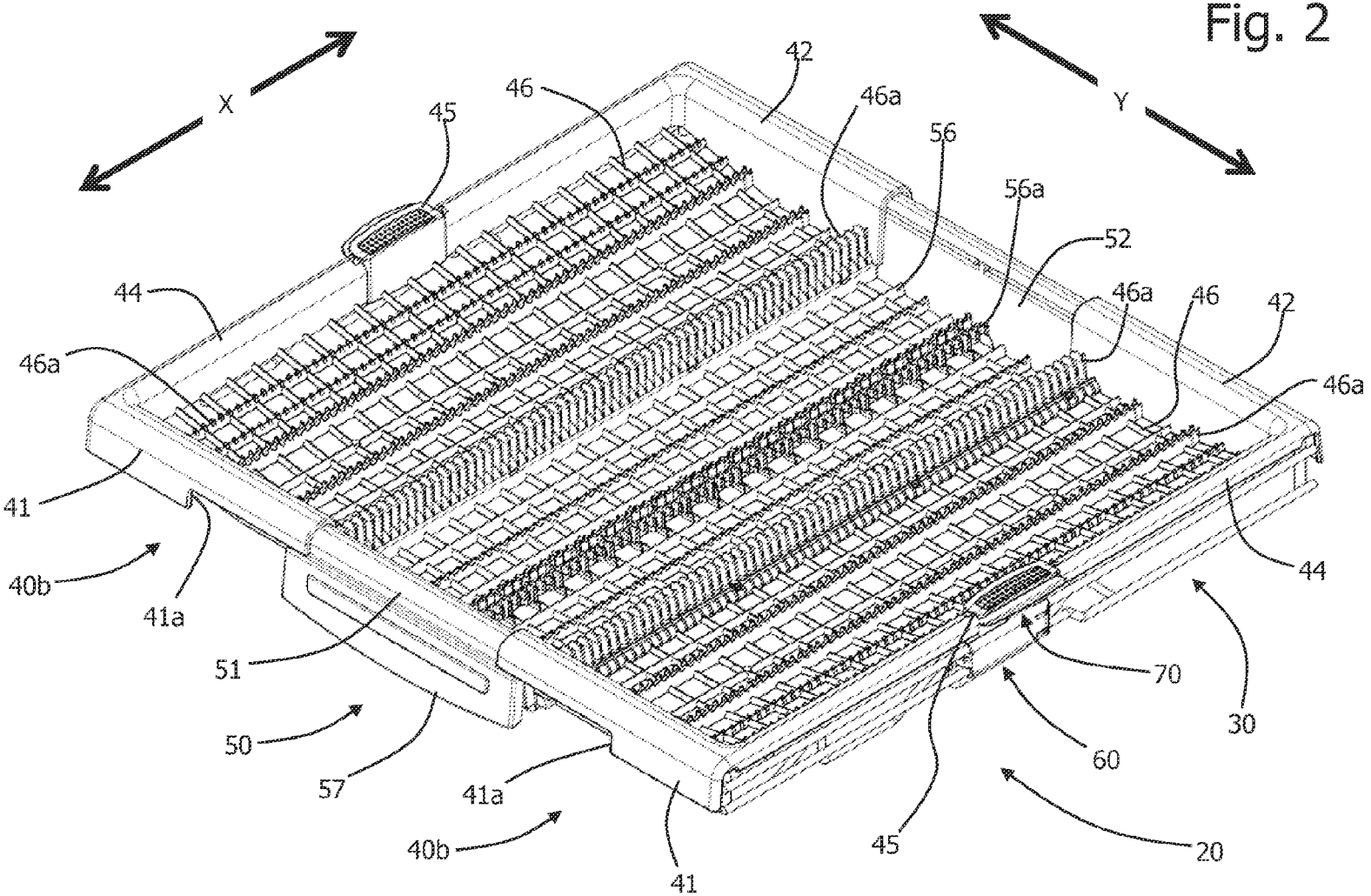
FIG. 2 is a schematic perspective view of a cutlery tray according to the disclosure.
Figure 8:
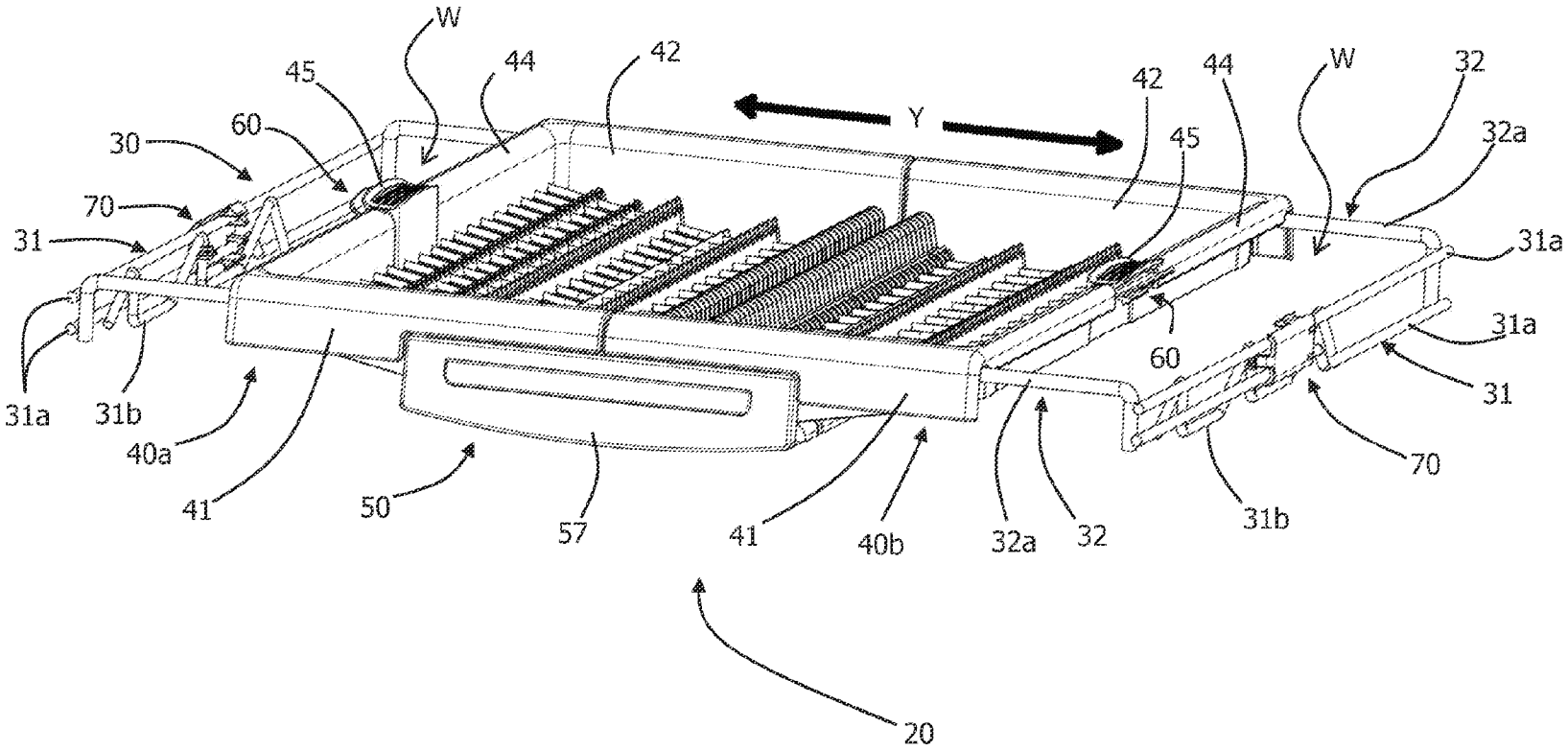
Figure 9:
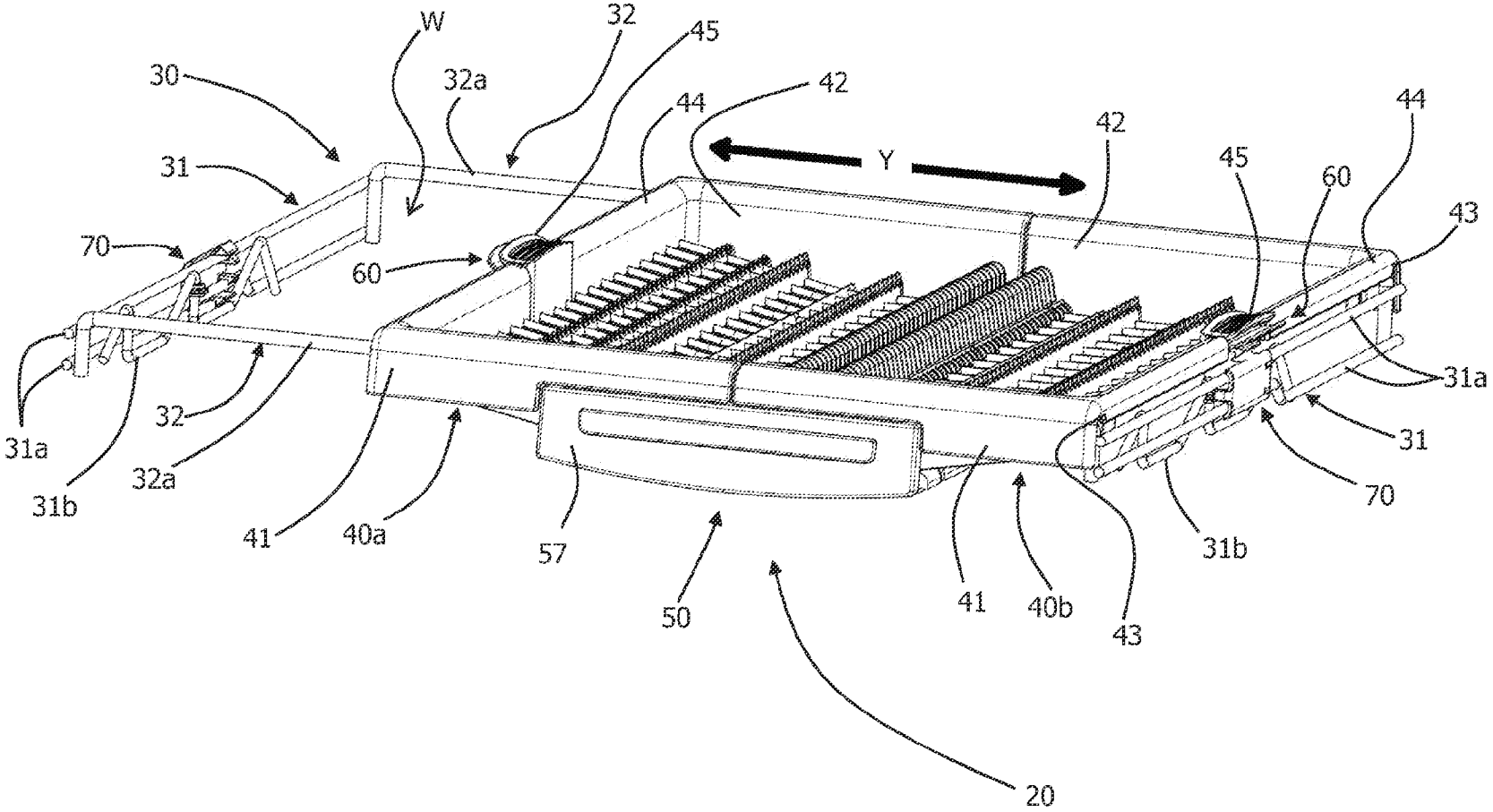

the FIGS. 8 and 9 are perspective views of a cutlery tray according to the disclosure, in configurations of use different from that of FIG. 2.

DETAILED DESCRIPTION OF THE DISCLOSURE

The reference to "one embodiment " in the context of this description is intended to indicate that a particular configuration, structure or characteristic described in relation with the disclosure is included in at least one embodiment. Hence, phrases such as "in one embodiment" and similar that may be present in different points of this description, do not necessarily refer to the same embodiment. Furthermore, particular conformations, structures, or characteristics may be combined in any adequate way in one or more embodiments, also different from those shown. The references used herein are for convenience only and therefore do not define the scope of protection or the scope of the embodiments.

The tray object of the disclosure is here defined as "cutlery" for simplicity, provided that one of its main aims is indeed to support cutlery items that must be washed. Obviously, this does not exclude that the tray can be also used to hold tableware items more bulky than the cover cutlery, such as serving cutlery (for example ladles, carving forks, etc.).

It should also be noted that in the following description only the elements that are useful for the understanding of the disclosure will be described, assuming that the machine according to the disclosure comprises all the elements per se known for the operation of a dishwasher, including its possible external casing, a user interface, a control system, level sensors means, a water heater resistor, a dispenser of washing agents, etc.

Figure 1:
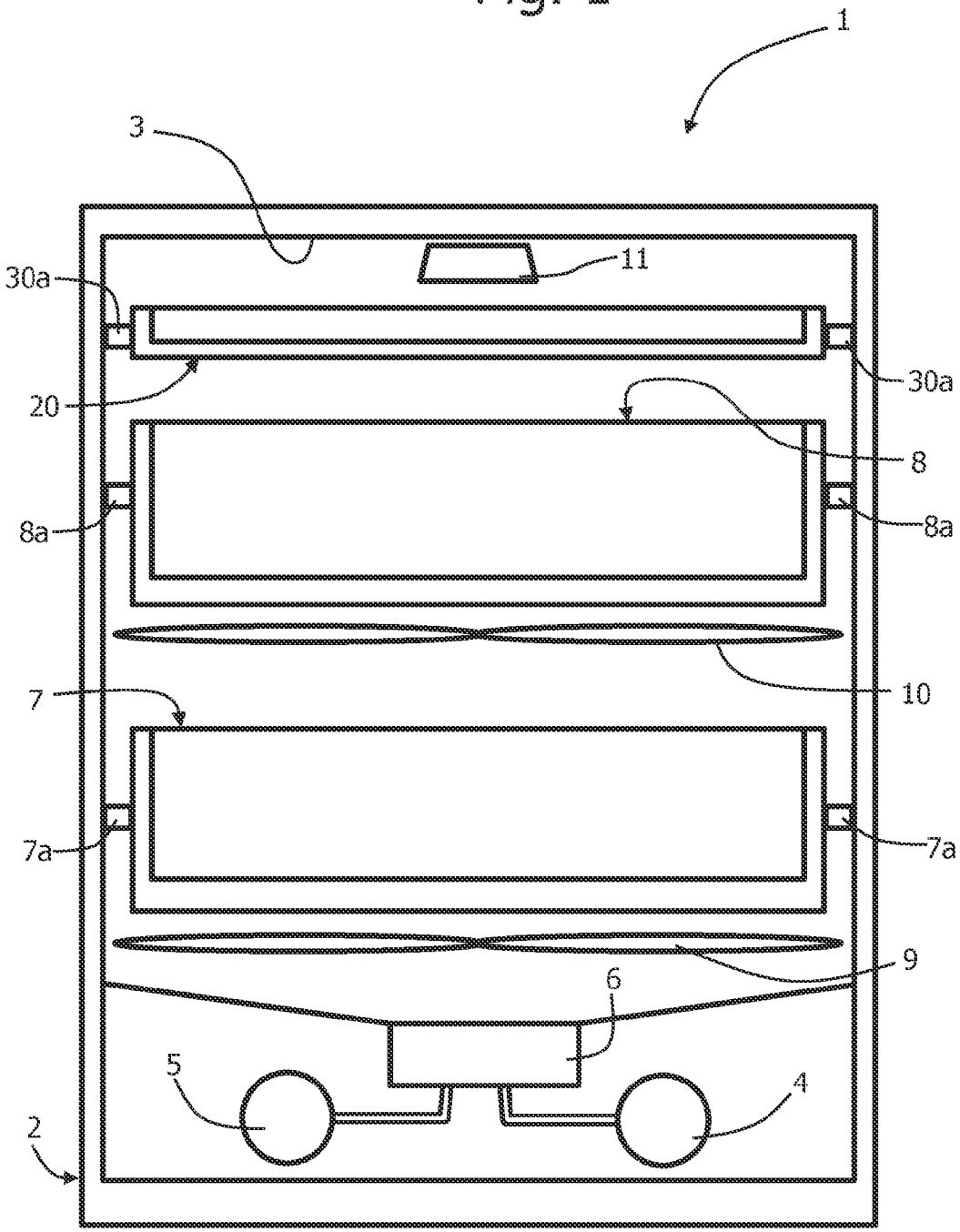
FIG. 1 is a schematic sectional representation of a dishwasher having a cutlery tray according to the disclosure, in a configuration of use.

In FIG. 1 there is shown in schematic way a dishwashing machine for domestic use in one possible embodiment of the present disclosure. The machine 1 is shown limited to the parts of immediate interest to the understanding of the present disclosure. The machine 1 has a structure 2 which comprises a wash tub 3, at the bottom of which is defined a housing space in which various functional components of the machine 1 are positioned, among which a washing pump 4, a drain pump 5, part of sump 6 for collection of the water, as well as other components not shown in the figure for sake of greater clarity of the drawing. The wash-tub 3, of overall known conception, comprises an upper wall, a lower wall and four side walls one of which—the front wall—consists of a internal shell of the machine door, not shown here (the so-called "counter door"). Inside the tub 3 are provided a lower basket 7 and an upper basket 8, intended to contain their respective crockery loads. The baskets 7 and 8 are mounted—using guides 7*a* and 8*a* per se known—in order to be able to be extracted and/or removed through the front opening of the tub 3.

The machine 1 has a sprinkler system, which includes a first sprinkler member 9, to sprinkle with water, from the bottom, the crockery contained in a respective basket, in this case the lower basket 7. In the case shown, having the machine two baskets, the sprinkler system also comprises a second sprinkler member 10, for sprinkling with water from the bottom the crockery items contained in the upper basket 8. The sprinkler system of machine 1 also comprises an upper sprinkler 11, placed above the upper basket 8 of the machine, for example, a substantially shower-like rotatable sprinkler, mounted at the upper wall of the tub 3. As in the prior art, the sprinkler system is fed by means of the wash pump 4, through a hydraulic circuit not shown, of any known type in the field.

The machine 1 further comprises a cutlery tray, generally indicated with 20, placed in the tub 3 in a space between the upper basket 8 and the upper wall of the tub 3. As can be imagined, the upper sprinkler 11 can sprinkle water from the top on the tray 20. In the example, the tray 20 has approximately the same width and length dimensions of the underlying basket 8 and 9, but it has general configuration more flattened with respect to them. The cutlery tray 20 has a frame, which is withdrawably mounted in wash tub 3, similarly to the baskets 8 and 9: therefore, in the case shown, the tray is substantially configured as a sliding drawer.

The structure of a possible embodiment of the tray, together with construction details, is illustrated in FIGS. 2-9.

The tray 20 has a frame 30, which dimensions are substantially similar to those of the baskets 7 and 8, with a structure that supports a plurality of inserts. Preferably, this structure is a wire structure, i.e. formed at least in prevalence by metal wire, preferably metal wire coated with a plastic material. In a preferred embodiment, the frame 30 has a substantially quadrilateral shape, with two longitudinal sides 31 (see FIGS. 7-9), or generally parallel to the direction of extraction of the tray and of the baskets 7, 8 from the tub 3, and two transverse sides 32, here corresponding to the front and to the back of the frame 30. The transverse sides 32 comprise in the example a structure formed by at least one transverse wire 32*a* (see FIGS. 8-9), while the longitudinal sides 31 preferably comprise two or more longitudinal wires 31*a* and further connecting wires 31*b*, comprising possibly end portions of the transverse wires 32*a*.

At the longitudinal sides 31 of the frame 30 guide members are coupled, represented only schematically in FIG. 1, where they are indicated by 30*a*, in order to allow the extraction of the frame itself from the tub 3, in the direction of extraction indicated by the arrow X in FIG. 2. The guide members 30*a* are not represented here, as they can be of the same design known in the field and comprise, for example small wheels through which the frame 30 is coupled in sliding way to lateral telescopic guides mounted on the opposite side walls of the tub 3.

The tray 20 further comprises a plurality of inserts, arranged in a movable way on frame 30 and on which can be arranged tableware items to be washed, among which at least a first insert 40*a* and a second insert 40*b*, which are arranged on the frame 30 in a horizontally displaceable way. In the example of embodiment illustrated the two inserts 40*a* and 40*b* are arranged so as to be displaceable horizontally on the frame 30 in a direction transverse to the direction of extraction X, as indicated by the arrow Y in FIG. 2.

In a preferred embodiment each insert 40*a*, 40*b* has a body of a plastic material that comprises—at two walls or opposite sides 41 and 42 generally parallel to the direction Y of horizontal displacement—guides for the sliding engagement with the structure of a corresponding side 32 of the frame 30, here the structure made up of the transverse wires 32*a*, respectively. The sides 41 and 42 of the inserts 40*a* and 40*b*, preferably in the form of generally vertical side walls, will be hereafter defined for simplicity's sake, even "front" and "back". Preferably the aforesaid guides comprise grooves or notches 43 defined in the front 41 and in the back 42 of the inserts 40*a* and 40*b*, some of which partially visible in FIG. 7, coupled on the wires 32*a* so as to be able to slide.

The plastic body of each insert 40*a*, 40*b* then has a further wall or side 44 that is generally perpendicular to the direction of displacement Y and is generally facing a respective side of the frame 30, here represented by a respective longitudinal side 31. Preferably, at the side 44, preferably in the form of a generally vertical wall, each insert 40*a*, 40*b* has a handle 45, adapted to facilitate the gripping and horizontal sliding of the insert itself.

The body of the inserts 40*a* and 40*b* then has a bottom 46 generally grid like, which preferably comprises supports and/or dividers for the positioning of individual cutlery items. Such supports, some of which are indicated with 46*a*, can be of any shape known in the field. In an embodiment, the plastic body of the inserts 40*a* and 40*b* fully defines the sides 41, 42 with the guides 43 and the bottom 46 with the corresponding supports 46*a* and it can be molded over to metal wires for strengthening of the structure, particularly at the bottom 46. Also the handles 45 are preferably integrally formed in the plastic body, which is preferably formed of a thermoplastic material molded by injection. In a preferred embodiment, the bottom 46 of the inserts 40*a*, 40*b* declines substantially from the side 44 towards the center of the tray 20, for example in order to keep cutlery items in a generally inclined condition that favours the downflow of the washing liquid.

According to the disclosure, the tray 20 comprises first coupling means for coupling in a releasable way the first insert 40*a* to the second insert 40*b*, in such a way that, in a coupled condition of the aforesaid first coupling means, the first insert 40*a* is horizontally displaceable on the frame 30 together with the second insert 40*b*, while in a released condition of the coupling means the first insert 40*a* and the second insert 40*b* are horizontally displaceable on the frame 30 independently to each other. In the preferred embodiment, the first coupling means are configured so that, in their engaged condition, they prevent relative movement between the two inserts 40*a* and 40*b*.

In a preferred embodiment, the aforesaid first coupling means comprise a third insert 50, which is also arranged on the frame 30 in a horizontally displaceable manner. The third insert 50 is operatively set between the inserts 40*a* and 40*b*: for this reason, for simplicity, hereinafter the inserts 40*a* and 40*b* will be also defined "lateral", while the insert 50 will also be defined "intermediate".

The intermediate insert 50 has a respective body, configured as a distinct part with respect to the bodies of the inserts

40*a* and 40*b*, preferably made of a plastic material. Also the body of the intermediate insert 50 has, at respective opposite sides 51 and 52—hereafter also defined as "front" and "back"—respective guides for sliding engagement with the structure of the frame 30 here consists of the wires 32*a*. These guides of the insert 50 are not visible in the figures, but they can be similar in shape to the notches or grooves 43 of the front 41 and the back 52 of the lateral inserts 40*a* and 40*b*.

The body of the intermediate insert 50 has then a bottom 56, which is also generally grid-shaped, and possibly including respective supports and/or dividers 56*a* for cutlery items. Preferably, moreover, the front 51 of the insert 50 has a front handle 57, to facilitate displacement of the frame 30, and thus of the tray 20 as a whole, according to its direction X of extraction from the tub 3.

Preferably also the plastic body of the insert 50 integrally defines the respective front 51 and back 52, preferably in the form of generally vertical walls, with the corresponding guides, and the bottom 56 with the possible support 56*a;* also the body of the insert 50 may be molded over metal wires for strengthening of the structure, particularly at its bottom 56. Also the front handle 57 is preferably integrally formed in the plastic body of the insert 50, which is preferably formed of a thermoplastic material molded by injection. The bottom 56 of the insert 50 may have at least in part a V shape or, more generally, decline towards its center, in order to facilitate the evacuation of the washing liquid from the cutlery items.

In an embodiment, such as the one exemplified in the figure, the bottom 56 of the intermediate insert 50 is at a height generally lower than the bottom 46 of the inserts 40*a*, 40*b*, so that they can be displaced at least in part over the insert 50. However, alternative embodiments are not excluded, in which the lateral inserts 40*a* and 40*b* are displaceable at least in part below the intermediate insert 50, or even embodiments in which a lateral insert is displaceable in part over the intermediate insert and the other lateral insert is displaceable under the intermediate insert.

As can be seen for example from FIGS. 8 and 9, when the lateral inserts 40*a* and 40*b* are displaced over the intermediate insert 50 (and are—as will be seen—coupled together), the insert 50—or at least the corresponding space to support the tableware—is substantially completely hidden by the two inserts 40*a* and 40*b*. It will be appreciated, however, that the front 41 of the lateral inserts 40*a* and 40*b* and the front 51 of the intermediate insert 50 are shaped in such a way that the front handle 57 remains however directly accessible. For this purpose, in the exemplified embodiment, the fronts 41 of the lateral inserts 40*a* and 40*b* define respective recesses 41*a* (FIG. 2), opposite to each other, in which respective portions of the front handle 57 can be received.

Preferably, and as in the case of the exemplified embodiment, the slidable coupling between the lateral inserts 40*a* and 40*b* and the intermediate insert 50 is approximately of a telescopic type. In the case shown, respective parts of the front 41 and the back 42 of the lateral inserts 40*a* and 40*b* are coupled in a sliding way above respective parts of the front 51 and of the back 52 of the intermediate insert. Obviously, in the case of alternative configurations, such as those just cited above, the slidable coupling arrangement between the inserts 40*a*, 40*b* and 50 will be modified accordingly.

In an embodiment, such as that exemplified, the means for coupling in a releasable way the two lateral inserts 40*a* and 40*b* include first and second engagement means of the insert 50, which are engageable in a releasable manner with engagement means of the insert 40*a* and insert 40*b*, respectively. The arrangement of the aforesaid engagement means is such that, in an engaged condition thereof, the insert 50 is horizontally displaceable on the frame 30 together with the two inserts 40*a* and 40*b*, while in the disengaged condition of the first engagement means or of the second engagement means, the corresponding insert 40*a* or 40*b* is horizontally displaceable on the frame independently of the other insert and independently of the insert 50.

Figure 3:
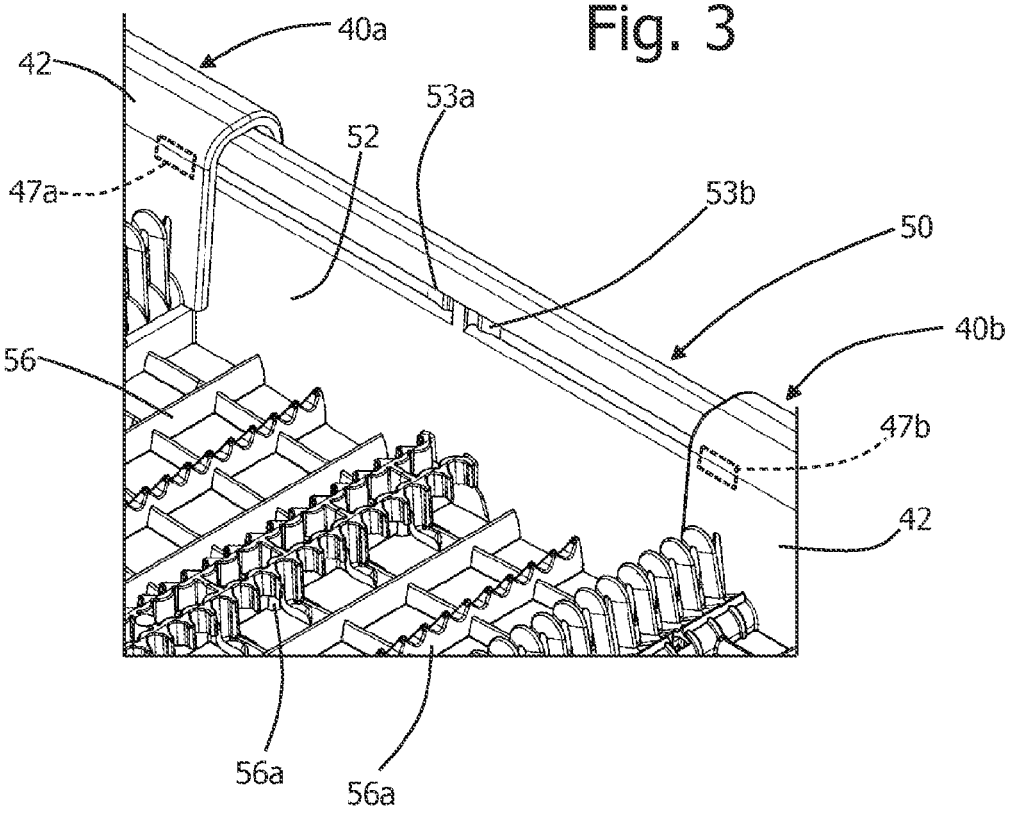
FIGS. 3 and 4 are details of the tray of FIG. 2.

In an embodiment, such as the one exemplified, the first and the second engagement means comprise respective teeth or couplings on at least one of the front 51 and back 52 of the insert 50. A possible realization of the aforesaid teeth, which preferably are integrally defined in the plastic body of the insert 50, is shown in FIG. 3, where they are indicated by 53*a* and 53*b*, here at a groove or slot in the back 52. In the figure are visible teeth 53*a*-53*b* formed in the back 52, but similar teeth are preferably provided also on the front 51, at corresponding positions. On the other hand, the homologue engagement means provided on each of the two inserts 40*a* and 40*b* comprise respective teeth or couplings, on at least one of the front 41 and the back 42 of the respective insert, suitable to engage in a releasable manner the teeth or coupling 53*a*, 53*b*, respectively. In FIG. 3, the engagement means of the inserts 40*a* and 40*b* are schematically represented in dashed line (since they are not in view) and indicated with 47. In general terms, the type of coupling between the elements 47*a*-53*a* and 47*b*-53*b* is an elastic or snap coupling, and in this context, for example, at least one of the teeth or couplings 47*a*, 47*b* and 53*a*, 53*b* may include an elastically displaceable part. It will be appreciated that, when the teeth or couplings 47*a*, 53*a* or 47*b*, 53*b* are in their engaged condition, relative movements are prevented between the two inserts 40*a* and 40*b*, and with respect to the insert 50. From this condition, to separate between them the inserts 40*a* and 40*b*, the user must apply, acting for example on the handles 45, a traction force in the direction Y, which force is sufficient to overcome the elastic reaction of the coupling 47*a*,53*a* and/or 47*b*, 53*b*. It will be moreover appreciated that the practical realization of the releasable engagement means here represented by the elements 47*a*, 47*b* and 53*a*, 53*b* can vary from the one exemplified and be even more sophisticated, comprising—for example—a control member which can be operated manually, possibly against the action of elastic means (for example a button coupling).

In a preferred embodiment, the tray 20 also comprises second coupling means for locking in a releasable manner each of the two inserts 40*a* and 40*b* to the frame 30, in a respective stop position, in which there are prevented horizontal displacements of each insert 40*a* and 40*b* individually or of the two inserts 40*a* and 40*b* coupled together. Preferably, the aforesaid second coupling means comprise at least a first retention device on each of the two inserts 40*a* and 40*b*.

In a preferred embodiment , such as the one exemplified, the above-mentioned first retention devices are indicated with 60 as a whole and are located at the sides 44 of the inserts 40*a* and 40*b*, preferably but not necessarily substantially at the handles 45. Preferably, moreover, also second retention devices 70 are provided, which are at the two sides 31 of the frame 30.

Figure 4:
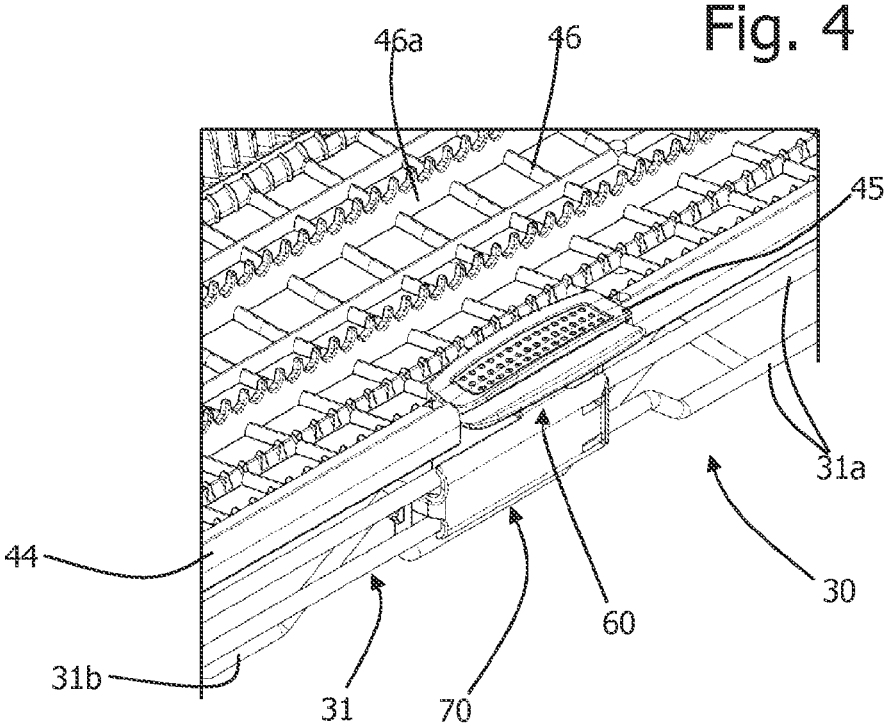

Also referring to FIGS. 4-6, each retention device 60 comprises a retention element 61 engageable with a respective catch element 71 of the corresponding retention device 70, as well as a manually operable element 62 for causing disengagement of the retention member 61 from the respective catch element 71.

In the example, the manually operable element 62 comprises a lever and the retention element 61 comprises a movable coupling tooth, which is elastically urged towards a respective position of engagement with the corresponding catch element 71, which is instead stationary. Preferably, the lever and the tooth are firm to each other, for example formed in a single piece of plastic material, and mounted on the body of the insert 40*a* or 40*b* to angularly displace according to an axis which is generally horizontal and parallel to the direction X of extraction of the tray 20. In the example shown in FIG. 6, between the body of the insert 40*b* and a single body that integrally defines the lever 62 and the tooth 61 a spring 63 is provided, particularly a leaf spring, which urges the tooth 61 in its engagement condition with the tooth 71.

Always referring to the illustrated embodiment, the retention device 70 has a body, preferably a plastic body, that integrally defines the corresponding catch element 71, as well as coupling elements 72 for its fixing to the structure of a respective side 31 of the frame, represented here by wires 31*a* and 31*b*. Preferably, at least one wire 31*b* is shaped so as to present a substantially vertical portion, close to the mounting area of the device 70, so that at least one coupling element 72 can engage such portion, in order to contribute to the lock of the device 70, and in particular preventing its movements in the direction X.

As can be realized, therefore, the devices 70 can be mounted in a simple and quick way, substantially in snap-fit way, on the structure of the frame 20.

Figure 7:
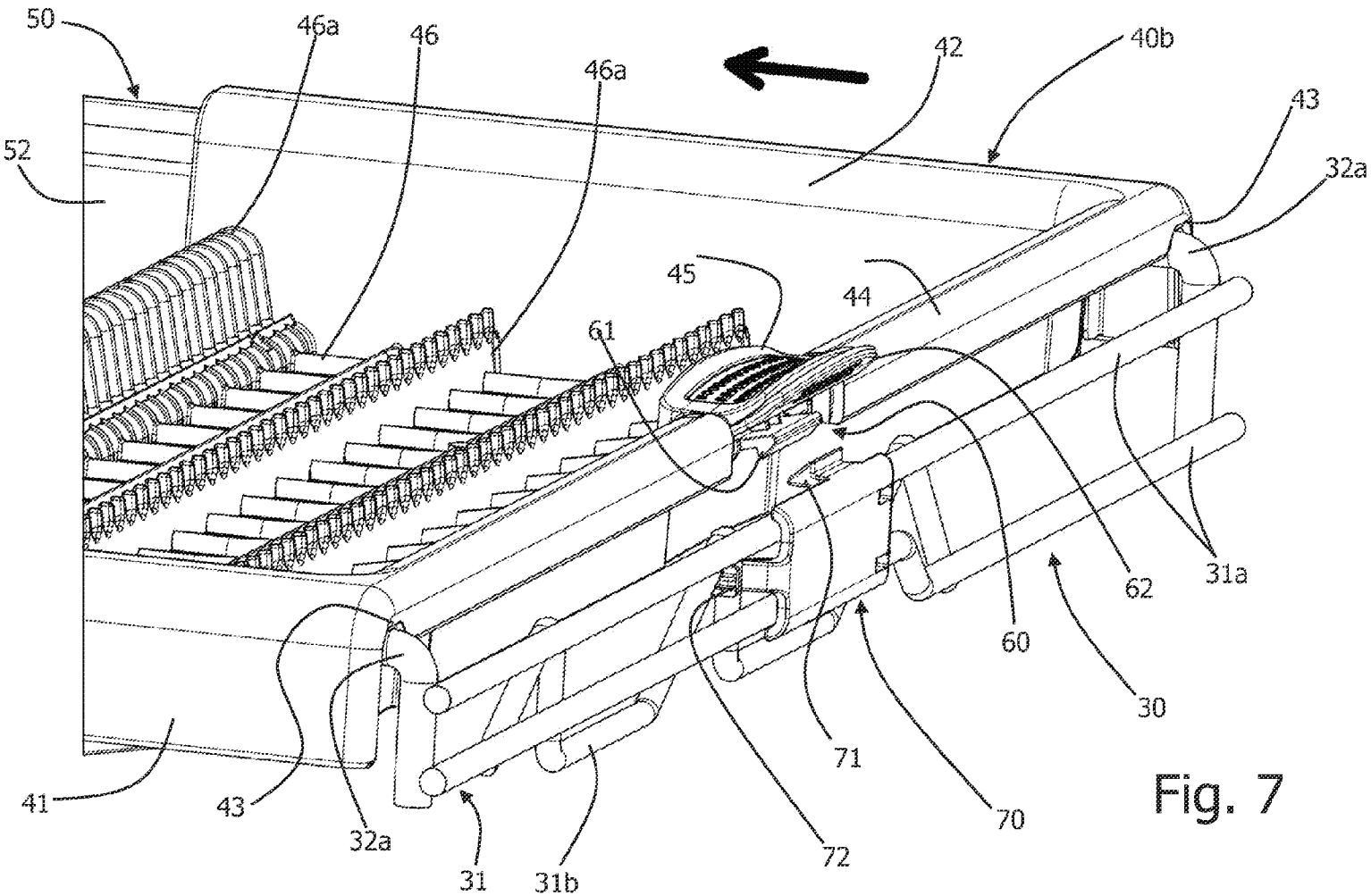
FIG. 7 is a schematic and partial perspective view similar to that of FIG. 5, with the said coupling means in a disengaged condition.

In FIG. 7 it is clearly apparent the condition of disengagement of the aforesaid second coupling means, here consisting of the devices 60 and 70, with the insert 40*b* that has already been moved slightly horizontally towards the center of the frame 30.

As mentioned, it is preferable that the device 50 is located at a respective handle 45 of the insert, and in particular below it, with the lever 62 which projects at least slightly sideways. In this manner, a user, when the tray 20 is in the respective extracted position, can for example rest part of the palm of a hand on the handle 45 and lift the lever up 62 by the fingers, so as to produce the disengagement between teeth 61 and 71. Always by exploiting the position of the hand on the handle, the user can then translate horizontally the insert 40*a* or 40*b* on the frame 30, for example up to lock it on the insert 50, through the couplings 47*a*, 53*a* and 47*b*, 53*b*, respectively.

It will be appreciated that the presence of the second retention devices 70 on frame 30, even if preferable, is not essential for the purposes of implementation of the disclosure. In alternative embodiments, in fact the functions of the devices 70 can be integrated directly in the frame 30, for example by using one of the wires 31*a*, 31*b* of a longitudinal side 31 to obtain the stationary catch element 71. Likewise, then, the first retention devices 60 can be configured in such a way that the corresponding movable coupling element 61 can engage in a releasable way directly with the structure of the frame 20, in particular with one of the wires that constitute it.

It will moreover be appreciated that the second retention means might have a arrangement reversed with respect to the one previously described, i.e. with retention devices similar to those indicated by 60 which are mounted on the longitudinal sides 31 of the frame 30 and which are configured to engage respective catch elements, for example integrally defined in the body of the inserts 40*a*, 40*b*.

Preferably, the slidable coupling between the lateral inserts 40*a* and 40*b* and the intermediate insert 50, for example the one previously defined as substantially telescopic, comprises catches that limit the maximum stroke in opening or in spacing apart from the intermediate insert 50. These catches are preferably positioned in such a way that, in the position of full opening of the inserts, as shown in FIG. 2, (with the devices 70 both in the respective coupling position with respect to the sides of the frame 30), the intermediate insert 50 remains substantially constrained in position between the lateral inserts 40*a* and 40*b*, i.e. without the possibility to horizontally displace with respect to them. In a particularly advantageous embodiment, said catches may include releasable coupling of the type of those indicated by 53*a* and 53*b* in FIG. 3, close to the opposite ends of at least one of the front 51 and the back 52 of the insert 50, in positions generally corresponding to those of the elements indicated with 47*a* and 47*b* always in FIG. 3.

According to further embodiments not shown the front 51 and/or back 52 of the insert 50 includes a plurality of elements similar to those indicated with 53*a*, 53 in FIG. 2, horizontally aligned with each other, so as to allow to constrain in releasable manner each lateral insert 40*a*, 40*b* in a plurality of different positions with respect to the insert 50, and hence with respect to the other lateral insert, thereby allowing to make further variable the useful width of the support part of the tableware embodied by the inserts.

From the above it will be appreciated that, in use, the tray 20 may assume a plurality of operating configurations. FIG. 2 illustrates a condition of complete opening or maximum capacity of the tray 20, in which the lateral inserts 40*a* and 40*b* are spaced apart to a maximum extent among them and with respect to the intermediate insert 50, with the couplings 47*a*, 53*a* and 47*b*, 53*b* coupled to each other and with the lateral inserts each being coupled to the corresponding side 31 of the frame 30, by means of the respective devices 60, 70.

From this position both the lateral inserts 40*a* and 40*b* may be released from the corresponding side 31 of the frame 30 and displaced towards the intermediate insert 50, obtaining the coupling of the means 47*a*, 53*a*, on the one hand, and of the means 47*b*, 53*b* on the other hand, in order to obtain a minimum capacity of the tray 20, as highlighted in FIG. 8. It will be appreciated that, from this condition, the assembly comprised of the three inserts can be freely translated horizontally to the right or to the left, and to obtain then the coupling to one of the sides 31 of the frame 30, via the corresponding devices 60, 70, as highlighted in FIG. 9. Even in such a condition of minimum capacity the inserts are in any case bound together and to the frame: an area on the frame 30—indicated with Z in FIG. 9—is free, and in it there can projects for example bulky tableware that protrudes upwards from the underlying basket 8 of the dishwasher (see FIG. 1).

In addition, starting from the condition of FIG. 2, any one of the lateral inserts 40*a*, 40*b* may be released from the corresponding side 31 of the frame 30 and displace towards the intermediate insert 50, obtaining the coupling of the means 47*a*, 53*a* or 47*b*, 53*b*, also keeping the other lateral insert in the position thereof coupled to the corresponding side 31 of the frame 30, by means of the respective devices 60, 70. In such a condition, of intermediate capacity of the tray, the inserts 40*a* and 40*b* are anyway mutually constrained (through the insert 50) and to the frame 30: an area on the frame 30 - corresponding to that indicated with W in FIG. 8—is free and in it they there can projects bulky tableware that protrudes upwards from the underlying basket 8 of the dishwasher.

From the carried out description the characteristics and advantages of the disclosure are clear, mainly represented by the possibility of diversified and stable positioning of several parts of the cutlery tray. The presence of the described first coupling means allows to prevent unwanted relative movements between the two inserts 40*a* and 40*b*, as well as with respect to the insert 50. Applicant had the opportunity to observe that, in certain conditions of use of trays of the type described in EP 2201887 A, the inserts may change their relative position in an unwanted manner, particularly due to vibrations of operation of the machine and/or water jets emitted from the sprinkling system that reach the parts of the tray. This problem can occur when the tray is not loaded with particular care, i.e. not by using the corresponding supports/dividers for the items to be washed, but also when the load is small or absent. The first coupling means allow to overcome this problem, in a simple manner. In this context, the first coupling means, which bind in relative stable positions the inserts, also allows to increase the possible configurations of use of the tray, as needed. The presence of the second coupling means, when they are provided for, allows in addition to further increase the reliability of use of the tray as a whole, ensuring the stable maintenance of the configuration chosen by the user for the inserts relative to the frame.

It is clear that many variations are possible for the man skilled in the art to the cutlery tray described as an example without departing from the scope of the disclosure as defined the attached claims.

The presence of the intermediate insert previously described, even if preferable, is not strictly necessary for the purposes of implementation of the disclosure. In accordance with variant embodiments not represented even only two inserts may be provided, of a conception similar to the inserts 40*a* and 40*b*, slidingly coupled together in a substantially telescopic way (for example with parts of an insert that overlap parts of the other insert), and in which, on the front and/or on the back of these inserts there are provided first releasable coupling means, for example technically equivalent to the ones previously indicated with 47*a*, 53*a* and 47*b*, 53*b*. Preferably, in correspondence with the side of each insert and of the corresponding longitudinal side of the removable frame second releasable coupling means are provided, for example technically equivalent to those indicated previously with 60 and 70.

The disclosure has been described in relation to horizontal displacements of the inserts in a direction Y transverse with respect to the direction X of extraction of the tray from the dishwasher tub, but it will be appreciated that—using simple inversions of the positioning of elements previously described—the horizontal movements allowed for the inserts may occur in the direction of extraction.

According to further possible embodiments of the disclosure, second coupling means might be provided at least in correspondence of one of the front and the back of at least one of the horizontally movable inserts, in addition to or in alternative to those previously indicated with 60, in order to allow for releasable locking the same insert in a plurality of possible stop positions.

In accordance with possible variants, the supports 46*a* and/or 56*a* are formed in one piece with the body of the corresponding inserts and coated with a synthetic material softer than the one forming the said body, for example TPE, or defined by a part or accessory separate from the body of the corresponding insert, preferably made of softer material with respect to it, for example TPE, such an accessory being engageable to the bottom 46 or 56 of the corresponding insert.

The invention claimed is:

1. A dishwasher cutlery tray, comprising:

a frame withdrawably mounted in a wash-tub;

a plurality of inserts arranged in a horizontally displaceable manner on the frame and on which items to be washed can be arranged, the plurality of inserts comprising at least a first insert, a second insert, and a third insert;

the first insert having a first insert engagement means;

the second insert having a second insert engagement means; and the third insert being operatively set between the first insert and the second insert and the third insert having a first engagement means and a second engagement means releasably engageable with the first insert engagement means and the second insert engagement means, respectively, for releasably coupling the first insert to the second insert wherein:

in an engaged condition of the first engagement means and of the second engagement means, the third insert is horizontally displaceable on the frame together with the first insert and the second insert; and, in a disengaged condition of the first engagement means or of the second engagement means, the first insert or the second insert, respectively, is horizontally displaceable on the frame independently from the second insert or from the first insert, respectively, and independently from the third insert; and a frame coupling means to lock in a releasable manner each of the first insert and the second insert to the frame, in a respective stop position, in which horizontal displacement of the first insert or of the second insert or of the first insert together with the second insert is prevented.

2. The cutlery tray according to claim 1, wherein the inserts are arranged on the frame such that the inserts are horizontally displaceable on the frame in a direction that is transverse to the direction of extraction of the frame from the wash-tub.

3. The cutlery tray according to claim 1, wherein at least one of the first insert and the second insert is mounted displaceable above the third insert wherein in the engaged condition of the first engagement means and the second engagement means, a space for support of items to be washed of the third insert is substantially completely hidden by the first insert and the second insert.

4. The cutlery tray according to claim 2, wherein each insert has, at two opposite sides thereof that are generally parallel to the corresponding direction of horizontal displacement, guides for slidable engagement with a structure of a corresponding side of the frame and wherein the first insert and the second insert each have, at a further side thereof that is generally perpendicular to the direction of horizontal displacement and generally faces a respective further side of the frame, at least a respective part of the frame coupling means.

5. The cutlery tray according to claim 4, wherein the first and the second engagement means comprise a respective first coupling element on at least one of said two opposite sides of the third insert, and the engagement means of the first insert and the second insert comprise a respective second coupling element on at least one of said two opposite sides of the corresponding insert and capable to engage in a releasable manner with the respective first coupling element.

6. the cutlery tray according to claim 1, wherein the frame coupling means comprises a first retention device on each of the first insert and the second insert.

7. The cutlery tray according to claim 6, wherein the frame coupling means comprises a second retention device on each of two opposite sides of the frame.

8. The cutlery tray according to claim 7, wherein one of the first and the second retention device comprises:

a first retention element engageable with a respective catch element of the other one of the first and the second retention device, and a manually operable element to cause disengagement of the first retention element from the respective catch element.

9. The cutlery tray according to claim 8, wherein:

the manually operable element comprises a lever, the first retention element comprises a movable coupling tooth, the catch element is a stationary catch element, at least one of the lever and the movable coupling tooth being elastically urged towards a respective position of engagement with the stationary catch element, wherein the lever and the movable coupling tooth belong to the respective first retention device on each of the first insert and the second insert, and wherein the stationary catch element belongs to the respective second retention device on each of two opposite sides of frame.

10. The cutlery tray according to claim 9, wherein the second retention device has a body defining a second retention element and coupling means for fixing thereof to a wire-structure of the frame, at a respective said side of the frame.

11. The cutlery tray according to claim 4, wherein the first insert and the second insert each have a bottom that slopes down substantially starting from the afore said further side towards the center of the tray.

12. The cutlery tray according to claim 1, wherein the third insert has a front handle to ease displacement of the frame in a direction of extraction from the wash-tub.

13. The cutlery tray according to claim 1, wherein the frame coupling means comprises a first retention device on each of two opposite sides of the frame.

14. The cutlery tray according to claim 13, wherein the frame coupling means comprises a second retention device on each of the first insert and the second insert.

15. The cutlery tray according to claim 14, wherein one of the first and the second retention device comprises:

a first retention element engageable with a respective catch element of the other one of the first and the second retention device, and a manually operable element to cause disengagement of the first retention element from the respective catch element.

16. The cutlery tray according to claim 15, wherein:

the manually operable element comprises a lever, the first retention element comprises a movable coupling tooth, the catch element is a stationary catch element, at least one of the lever and the movable coupling tooth being elastically urged towards a respective position of engagement with the stationary catch element, the lever and the movable coupling tooth belong to the respective second retention device on each of the first insert and the second insert, and the stationary catch element belongs to the respective first retention device on each of two opposite sides of the frame.

17. The cutlery tray according to claim 16, wherein the first retention device has a body defining a second retention element and coupling means for fixing thereof to a wire-structure of the frame, at a respective said side of the frame.

* * * * *